US005660323A

United States Patent [19]

Spronk

[11] Patent Number: 5,660,323

[45] Date of Patent: Aug. 26, 1997

[54] BOX WITH SEALING TAB

[76] Inventor: Johannes Fredericus Spronk, Bcemater 61, 8244 CE Lelystad-Haven, Netherlands

[21] Appl. No.: 330,432

[22] Filed: Oct. 27, 1994

[30] Foreign Application Priority Data

Oct. 29, 1993 [NL] Netherlands ..... 9301872
Jan. 6, 1994 [NL] Netherlands ..... 9400021

[51] Int. Cl.[6] ..... B65D 17/32

[52] U.S. Cl. ..... 229/215; 229/160.2

[58] Field of Search ..... 229/221, 229, 229/233, 232, 234, 160.2

[56] References Cited

U.S. PATENT DOCUMENTS 1,596,699 8/1926 Waldron .
2,336,706 12/1943 Sunderhauf ..... 229/233 X
2,735,604 2/1956 Zerlin .
2,842,302 7/1958 Ryder .
2,866,586 12/1958 Moore ..... 229/233
3,003,673 10/1961 Clark .
3,057,533 10/1962 Silver .
3,618,847 11/1971 Koolnis ..... 229/233 X
3,814,301 6/1974 Niepmann ..... 229/233

*Primary Examiner*—Allan N. Shoap
*Assistant Examiner*—Christopher J. McDonald
*Attorney, Agent, or Firm*—Kinney & Lange, P.A.

[57] ABSTRACT

A box, folded from a blank comprising wall panels and glue panels, which has a substantially closed form and is provided with a dispensing opening provision (7) which extends in two wall panels adjoining each other through an edge of the box for forming a dispensing opening at the location of the edge, wherein at least one of the panels of the blank comprises an integrally formed sealing tab (9) which in a sealing position covers the dispensing opening provision (7) in such a manner as to prevent formation of the dispensing opening.

9 Claims, 10 Drawing Sheets

BOX WITH SEALING TAB

Figure 1:
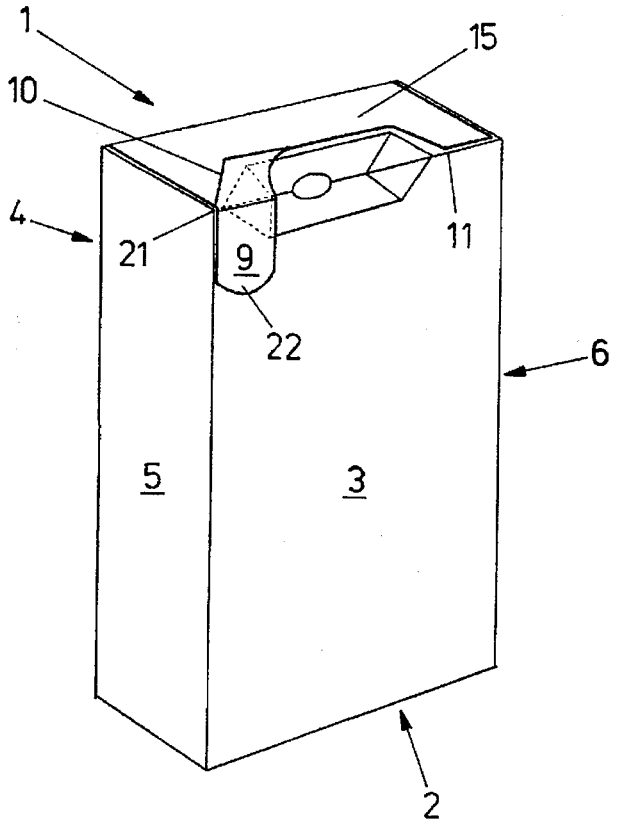

This invention relates to a box folded from a blank comprising wall panels and glue panels, which box has a substantially closed form and comprises a dispensing opening provision which extends in two wall panels adjoining each other through an edge of the box for forming a dispensing opening at the location of the edge.

Such a box is described, for instance, in Dutch patent application 9201217 .

Box-like packagings are frequently used for packaging sprinkling or pourable materials, such as, for instance, sandwich fillings, washing powder, beverages and liquid detergents.

Once the box has been filled, it is of particular importance that it be clear from the outside of the box whether it has been opened before, since this tells the user whether or not the contents of the packaging may have been manipulated, for instance through removal or addition of components. In addition, the possibility of such a check is particularly important in the case of perishable materials, for instance because of chemical, bacteriological and aromatic conditions.

With the known boxes, after they have been filled, a loose seal is fitted over the dispensing opening, in such a manner that the dispensing opening provision, and hence the box, cannot be opened without breaking the seal by pulling it away or tearing it. Such a seal consists, for instance, of a strip of film which is provided with a layer of glue on one side thereof and can be fitted transversely over the dispensing opening provision.

Such a loose seal enables a user to properly check the box but has a disadvantage in that the fitting of the seal is time-consuming and may be implemented incorrectly, which leads to partial or complete loss of the sealing action. Another disadvantage of loose seals is that they are typically made of a different material than the box, thereby giving rise to waste problems. Moreover, the seal may be left behind in parts adjacent to the dispensing opening and thereby adversely affect the sprinkling or pouring pattern of the box.

Accordingly, the object of the invention is to provide a box of the type described in the opening paragraph hereof, which does not have the above disadvantages while yet retaining the advantages thereof. To that end, the box is characterized, according to the invention, in that at least one of the panels of the blank comprises an integrally formed sealing tab which in a sealing position covers the dispensing opening provision in such a manner as to prevent formation of the dispensing opening.

Because the sealing tab is integrally formed on one of the panels of the blank and, in the erect position of the box, can be folded from that panel over the dispensing opening provision, an advantage is gained in that the sealing tab is automatically brought into the proper position, so that the sealing action is guaranteed. Moreover, the provision of the seal requires no or only few additional operations, so the seal can be provided in a relatively inexpensive manner. The seal of the box according to the invention is always made of the same material as the box, so that after use the seal can be discarded together with the box, which provides advantages from an environmental point of view. A further advantage of the box according to the invention is that it makes it impossible to forget to fit the seal since it is attached to the blank at all times during manufacture and filling of the box.

A first embodiment of the box is characterized in that the dispensing opening provision comprises a box portion bounded by a tear or perforation line which is closed in itself, which box portion extends in the two panels mentioned and which is adapted to be removed a single time for forming the dispensing opening, while the sealing tab, after the dispensing opening has been formed, can be brought into a closing position wherein the dispensing opening is at least substantially closed by the sealing tab. A box of such design can be made in a simple and inexpensive manner while moreover the dispensing opening provision, while still unopened, can be absolutely liquid-tight when the perforation or tear line is designed in such a manner that the panels are not pierced completely. Because the perforation or tear line extends in two adjoining wall panels and therefore the box portion to be removed is partly formed from one wall panel and partly from the other, it can be readily gripped to be removed. After the dispensing opening has been formed, it can be closed again by means of the sealing tab. In such a design of the dispensing opening provision, the sealing tab has not only a sealing function but also a closing function for the dispensing opening.

For the purpose of bringing the sealing tab into the closing position, the box may comprise a slit in which the sealing tab can be received.

An alternative design of the box is characterized according to the invention in that the dispensing opening provision is adapted for the formation of a closable dispensing opening, while the sealing tab, which has been integrally formed with one of the panels of the box, is connected to that panel through a tear or perforation line, so that the sealing tab, after having been dislodged from the sealing position, can be removed by way of the tear or perforation line.

Since in the closed condition the dispensing opening provision is at least partly covered by the seal, manipulation of the contents of the box, at least by way of the dispensing opening, is entirely precluded. The perforation or tear line makes it particularly simple to remove the sealing tab, and moreover the point where the tab is to be torn off is fixed. This prevents the possibility of a part of the sealing tab remaining behind adjacent the dispensing opening provision on a panel, which would adversely affect the sprinkling or pouring pattern of the box.

Preferably, edges of the mouth of the dispensing opening are completely covered and closed by the sealing tab in the sealing position thereof, so that contamination of the mouth edges is prevented.

In further elaboration, the sealing tab in its sealing position can close the dispensing opening in a completely liquid-tight manner. Of course, the liquid-tight design renders the box particularly suitable for packaging liquids, but equally so for protectively packaging materials which are sensitive to liquid.

In further elaboration of the box according to the invention, the tear or perforation line includes an angle with the edge in which the dispensing opening provision has been provided. This provides for a favorable direction in which the sealing tab is to be pulled loose, which slants relative to the edge, thereby preventing the possibility of one of the panels of the box being pulled loose as well.

It is moreover advantageous when the sealing tab, at least in the condition wherein it is folded over the dispensing opening provision, extends at least substantially transversely across the edge in which the dispensing opening provision has been provided. Thus, a cut of the dispensing opening provision which extends transversely to the edge can be covered entirely by means of a relatively narrow sealing tab, which means that the sealing tab can be made from a small quantity of material and can be removed simply and with little force without detracting from a proper sealing action.

Moreover, in this connection the direction in which the sealing tab is to be pulled loose is particularly advantageous.

Because the sealing tab, in accordance with a further elaboration of the box of the invention, is provided with an adhesive, the sealing tab can be fitted in the sealing position when the box is being manufactured, simply by folding it over the dispensing opening provision and pressing it down.

The invention further relates to a blank, suitable in particular for folding a box, in which blank a sealing tab extends from, and is formed integrally with, one of the panels of the blank. In this connection, the sealing tab is preferably formed on one of the glue panels because the sealing tab can then be simply provided with a layer of glue simultaneously with that glue panel.

Further elaborations of the invention are described in the subclaims and will be clarified on the basis of a number of exemplary embodiments of the box with reference to the drawing.

Figure 1A:
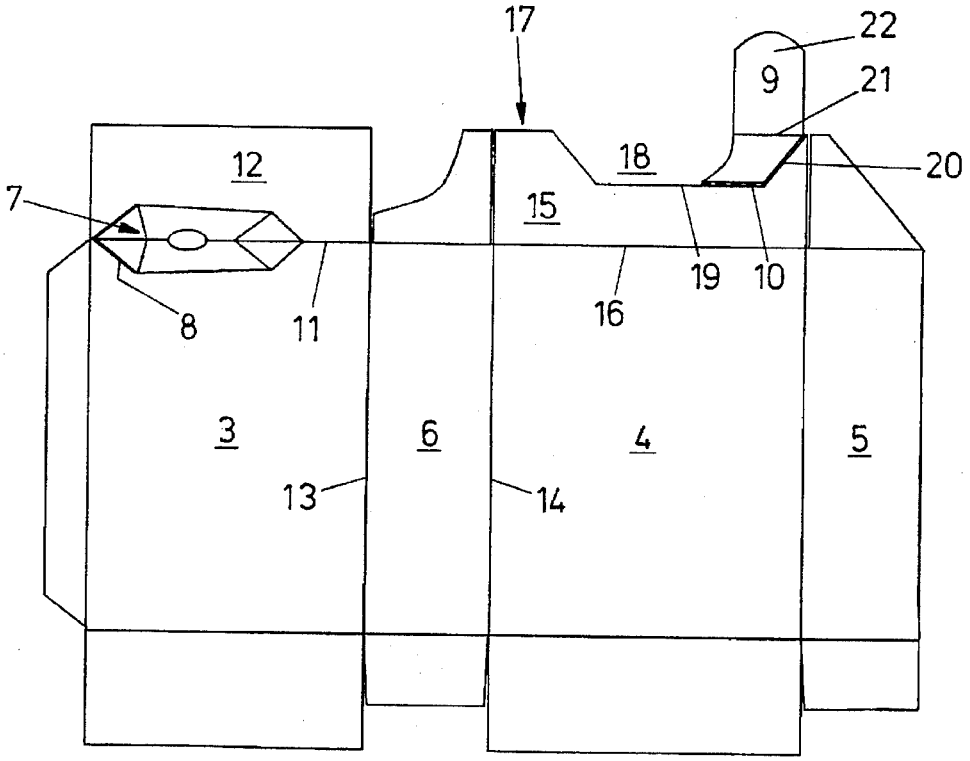
Figure 2:
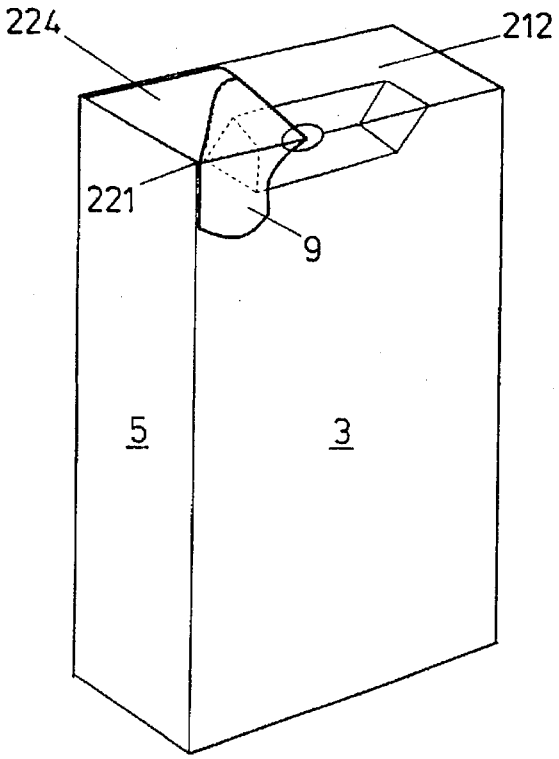
Figure 2A:
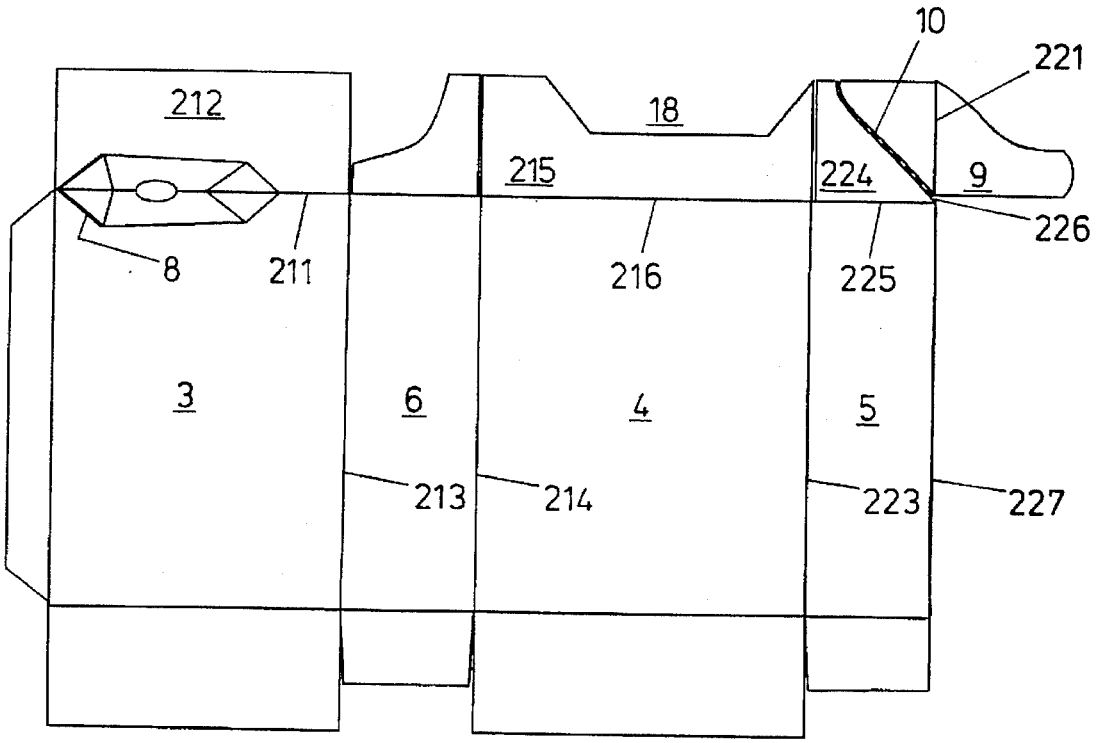
Figure 3:
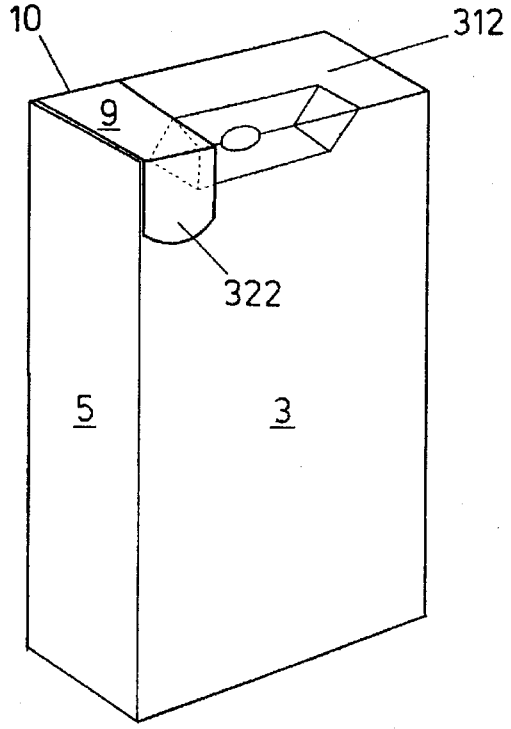
Figure 3A:
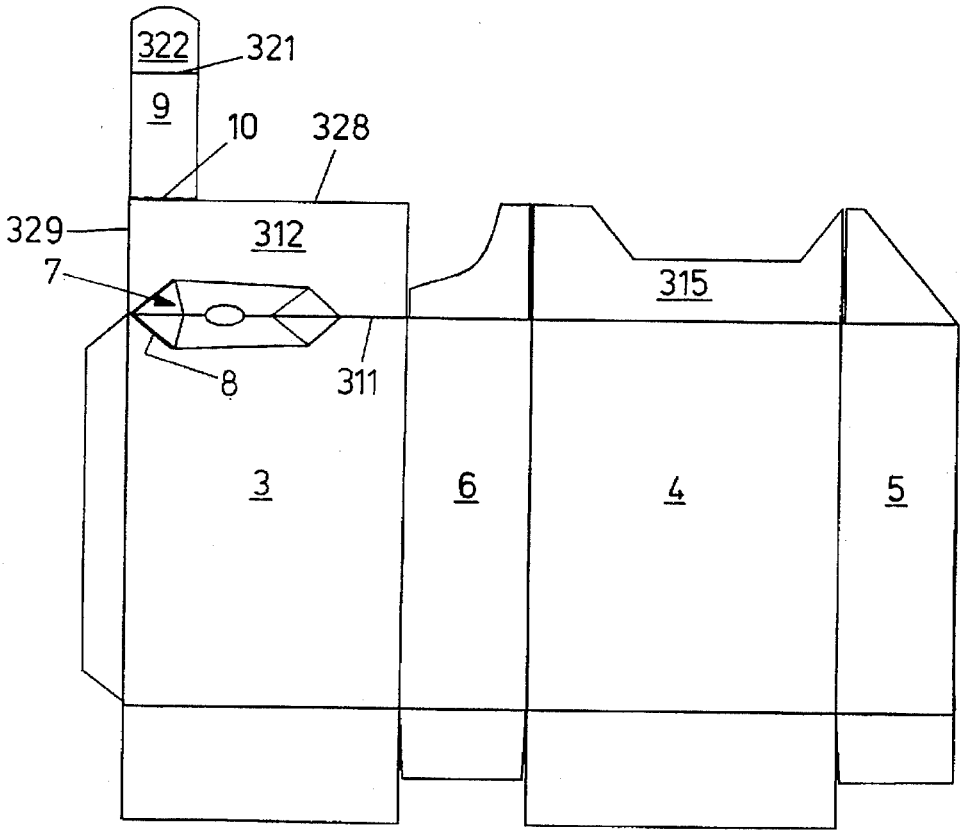
Figure 4:
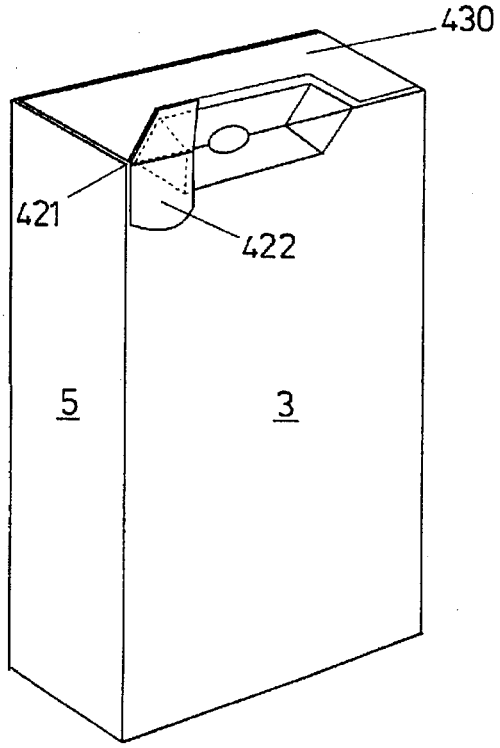
Figure 4A:
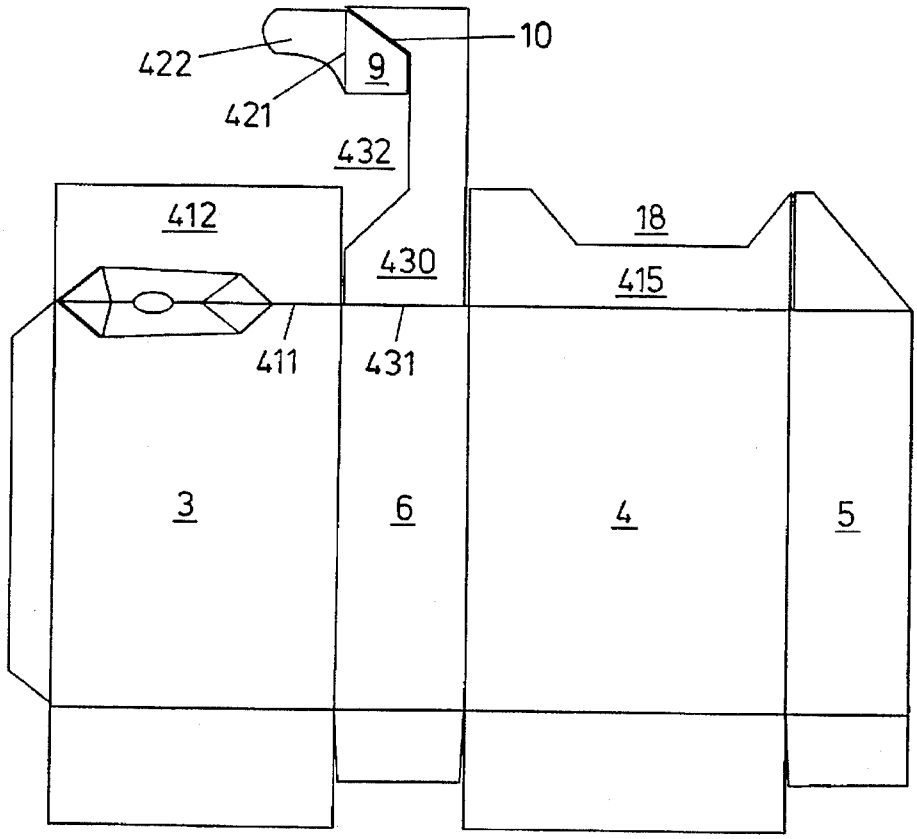
Figure 5:
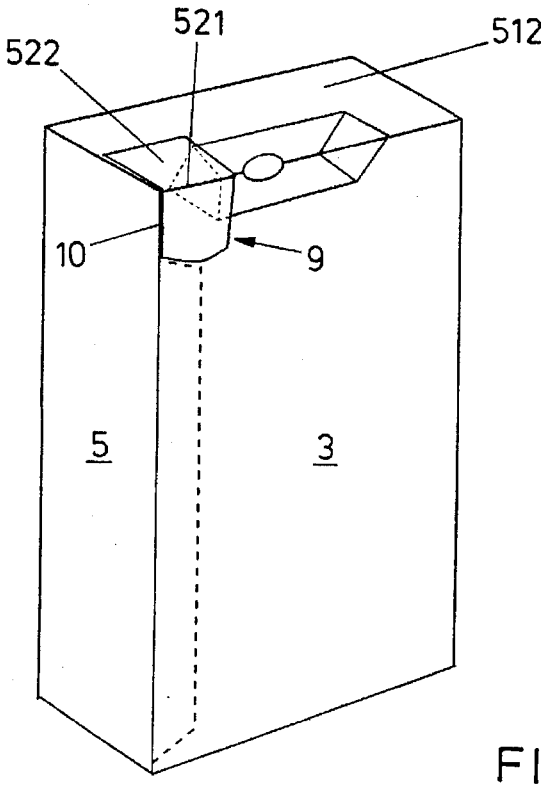
Figure 5A:
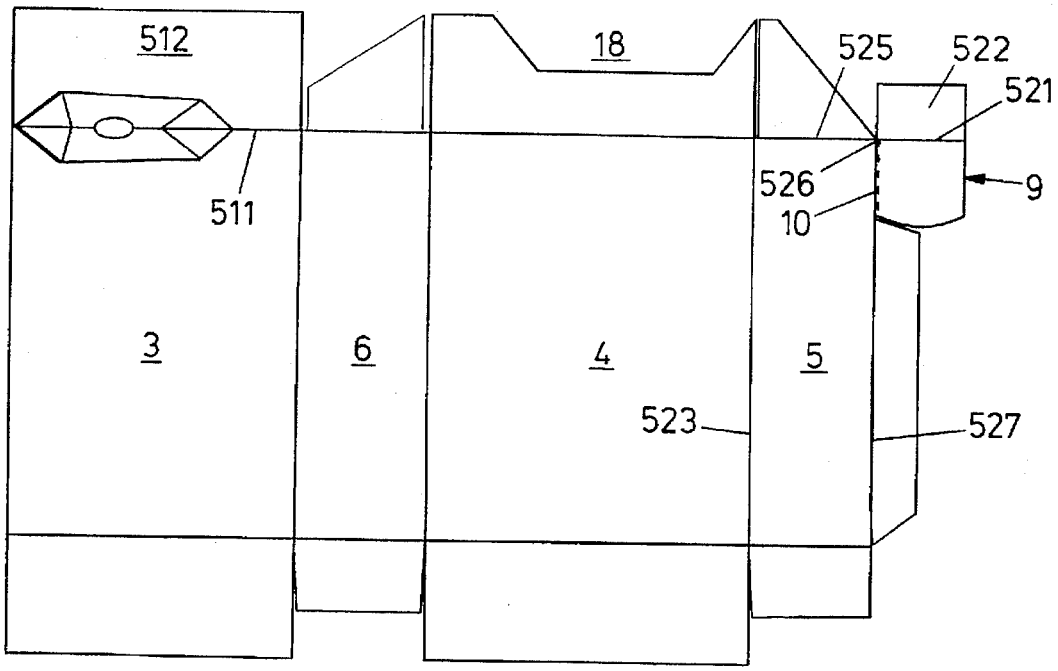
Figure 6:
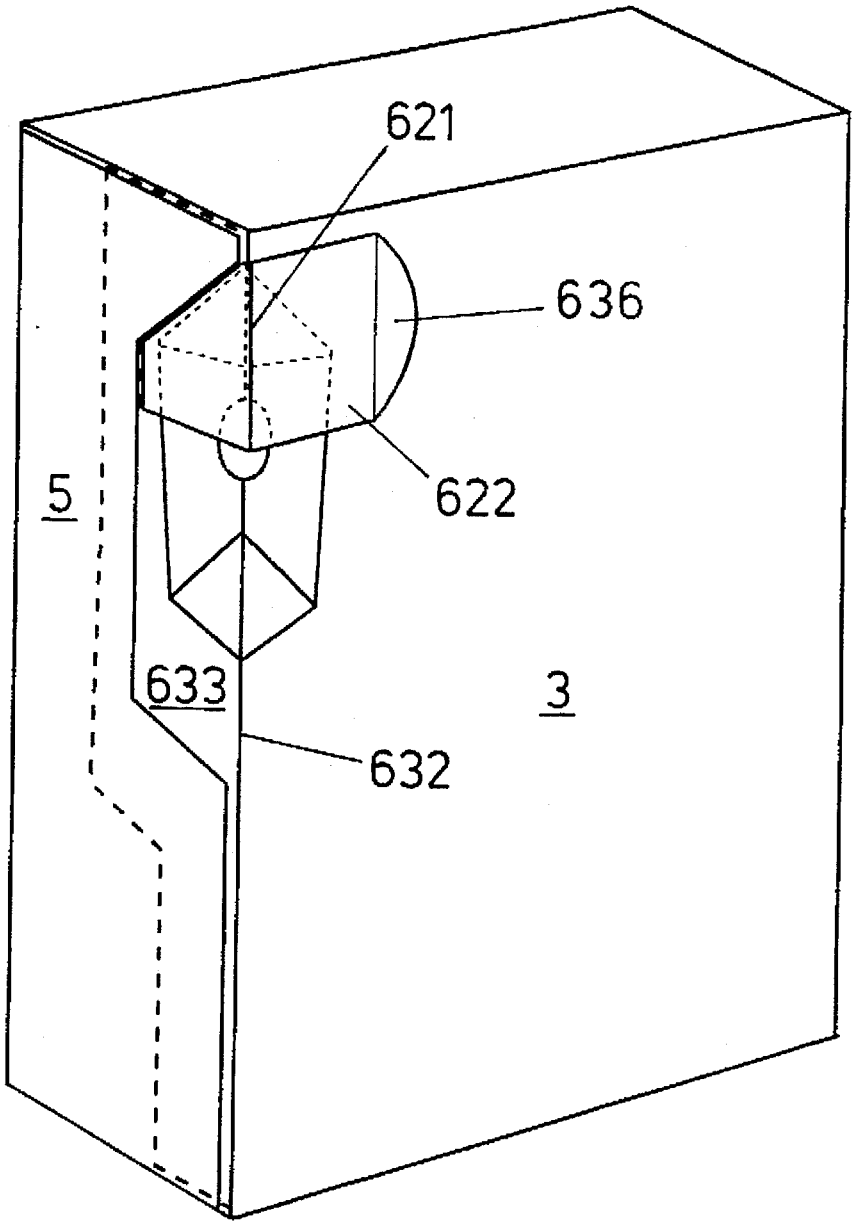
Figure 6A:
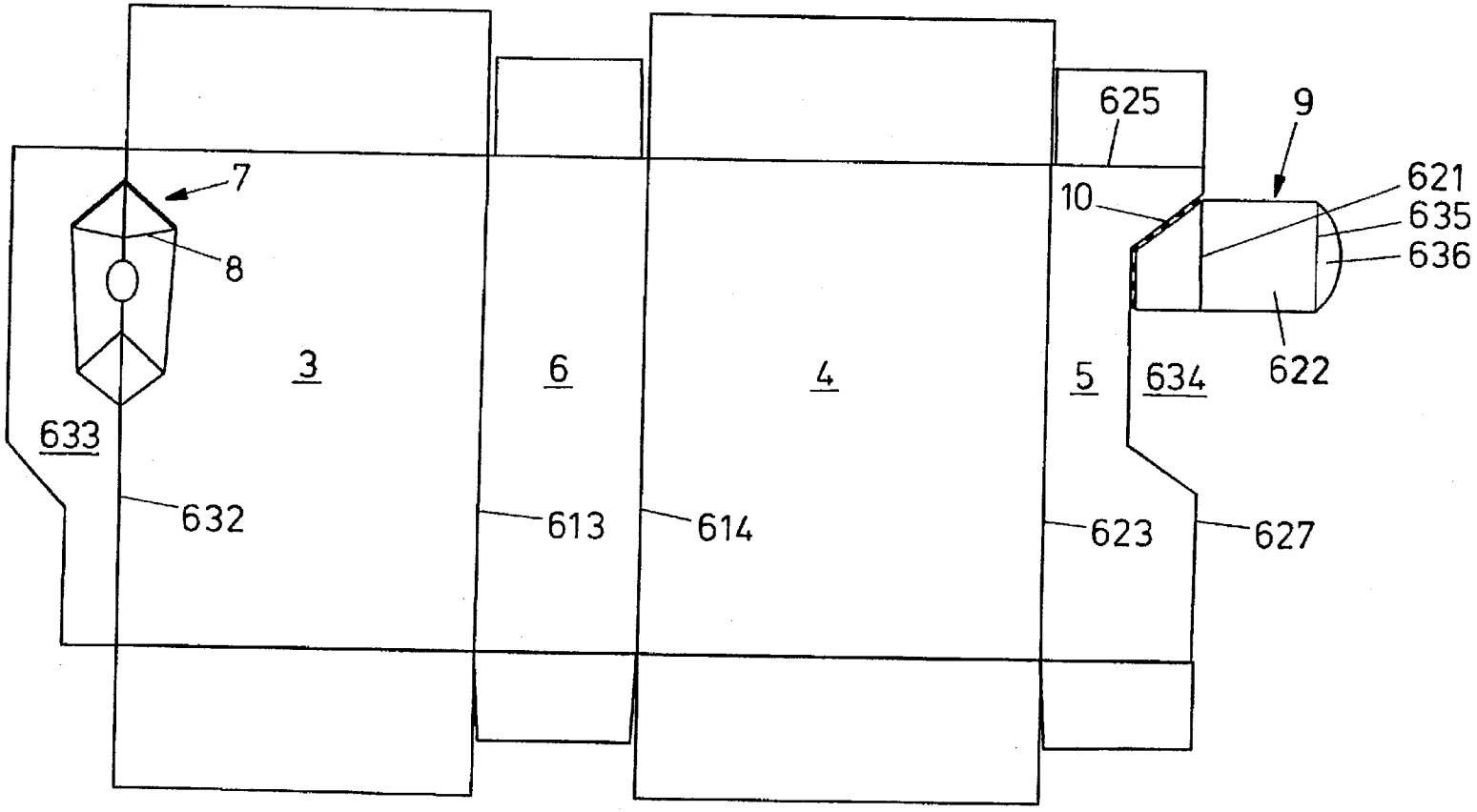
Figure 7:
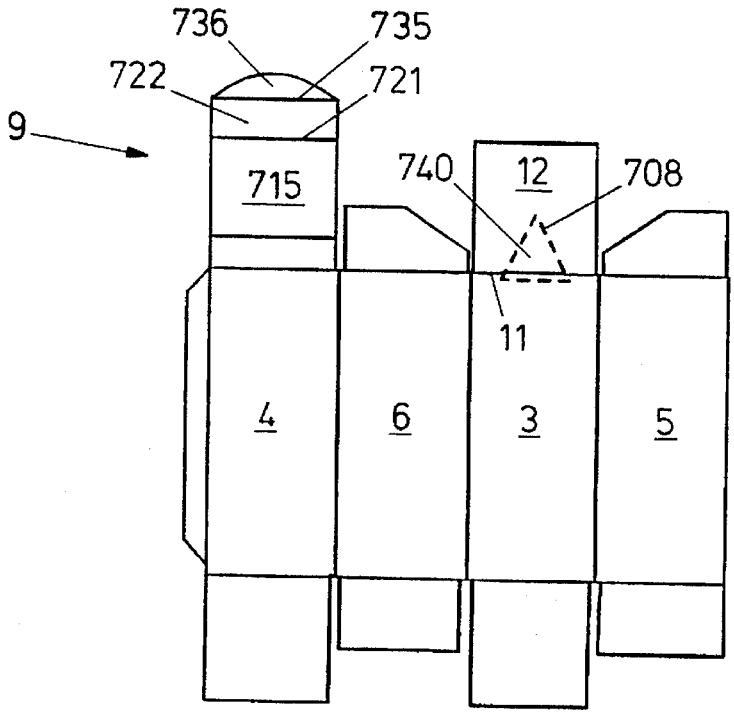
Figure 7A:
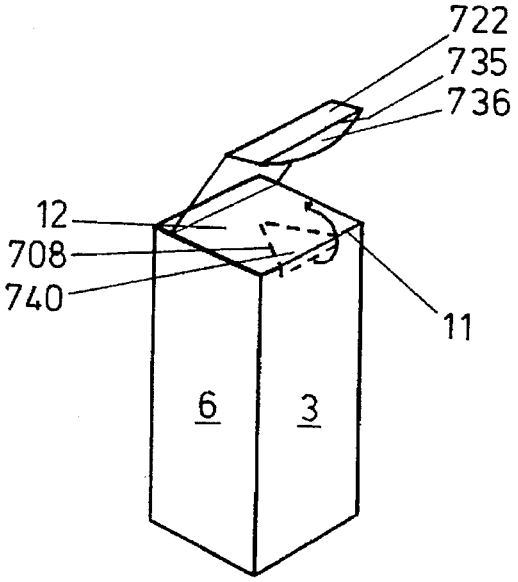
Figure 8:
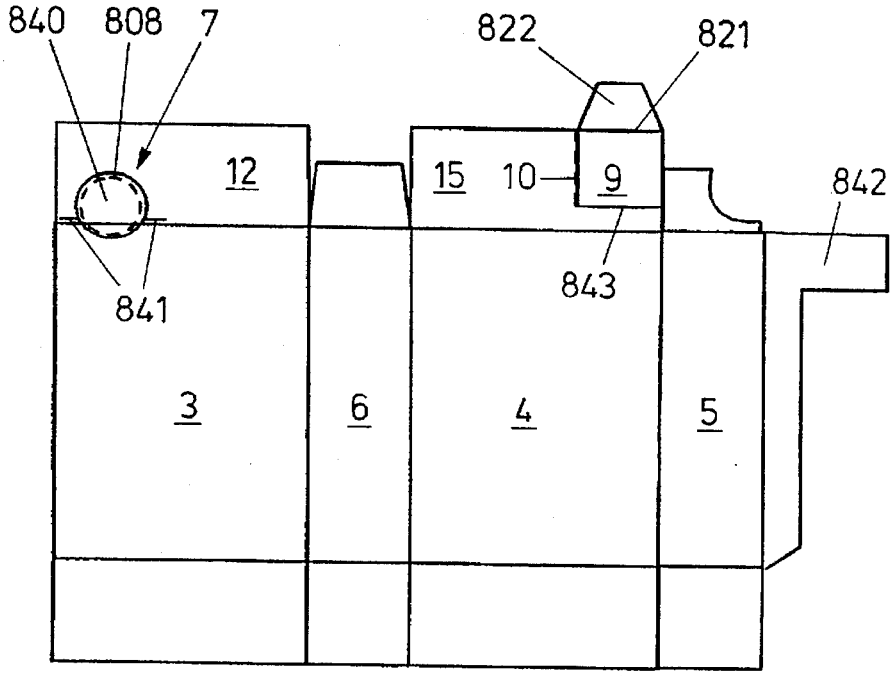
Figure 8A:
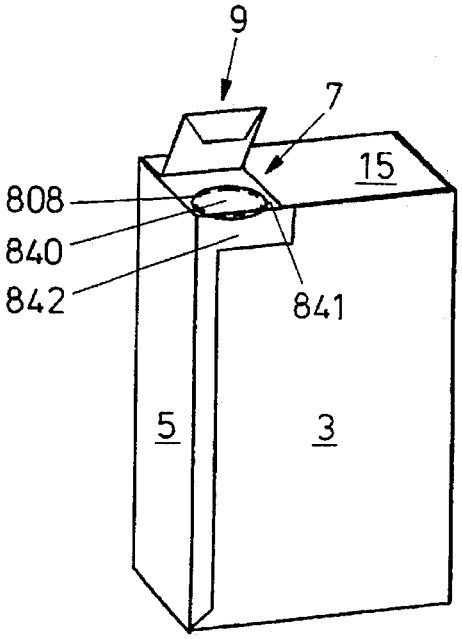
Figure 9:
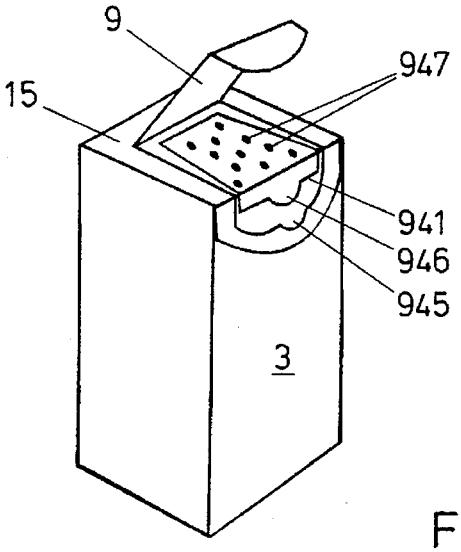

FIG. 1 shows a box according to the invention in a first embodiment;

FIG. 1*a* shows the opened position of the blank from which the box according to FIG. 1 can be folded;

FIG. 2 shows a box according to the invention in a second embodiment;

FIG. 2*a* shows the opened position of the blank from which the box according to FIG. 2 can be folded;

FIG. 3 shows a box according to the invention in a third embodiment;

FIG. 3*a* shows the opened position of the blank from which the box according to FIG. 3 can be folded;

FIG. 4 shows a box according to the invention in a fourth embodiment;

FIG. 4*a* shows the opened position of the blank from which the box according to FIG. 4 can be folded;

FIG. 5 shows a box according to the invention in a fifth embodiment;

FIG. 5*a* shows the opened position of the blank from which the box according to FIG. 5 can be folded;

FIG. 6 shows a box according to the invention in a sixth embodiment;

FIG. 6*a* shows the opened position of the blank from which the box according to FIG. 6 can be folded;

FIG. 7 shows a box according to the invention in a seventh embodiment;

FIG. 7*a* shows the opened position of the blank from which the box according to FIG. 7 can be folded;

FIG. 8 shows a box according to the invention in an eighth embodiment;

FIG. 8*a* shows the opened position of the blank from which the box according to FIG. 8 can be folded;

FIG. 9 shows a box according to the invention in a ninth embodiment; and

Figure 9A:
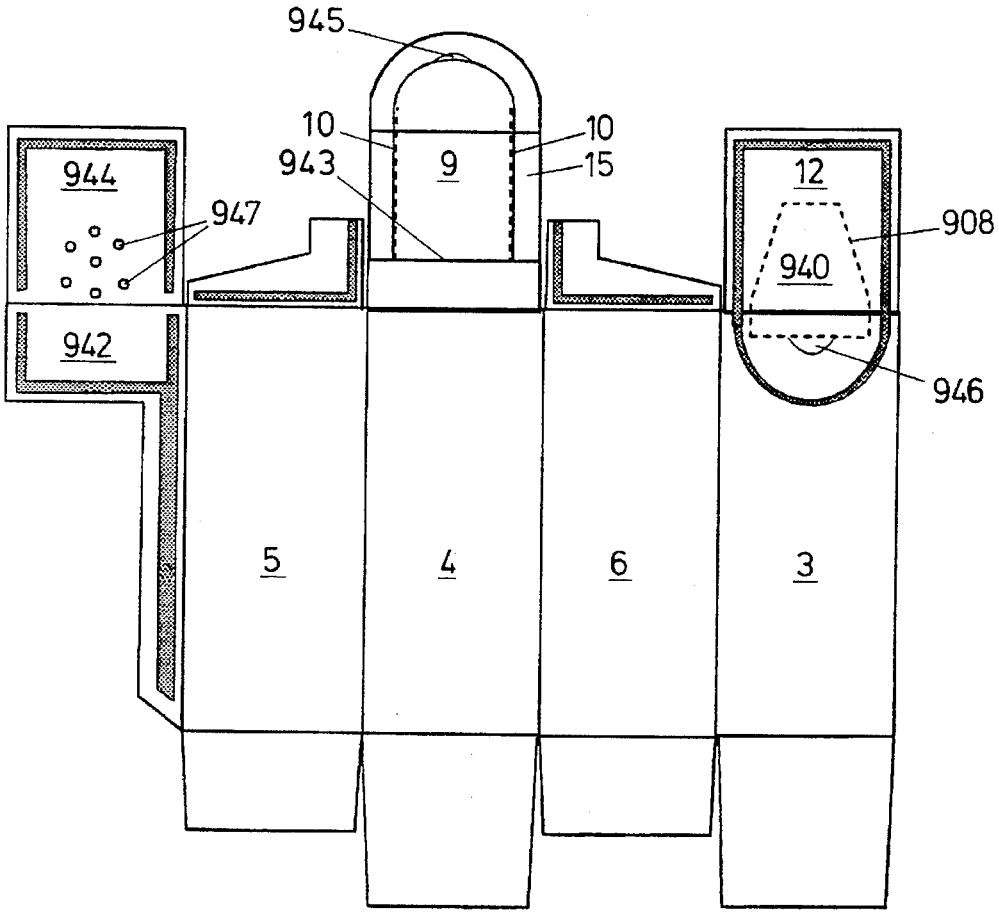

FIG. 9*a* shows the opened position of the blank from which the box according to FIG. 9 can be folded.

The box as shown in the drawing has a closed block shape, comprising a top 1, a bottom 2, a front 3, a rear 4, a first side 5 and a second side 6.

It holds for the embodiments shown in FIGS. 1–9 that one of the edges of the box is provided with a dispensing opening provision 7 for forming a dispensing opening, which dispensing opening comprises at least a cut 8 intersecting the relevant edge. It holds for FIGS. 1–6 that the dispensing opening provision can be opened by deformation of a part of the dispensing opening provision so as to form a dispensing opening and can be closed from the opened position by deformation.

The box shown in FIGS. 1–8 further comprises a sealing tab 9 which is formed integrally with a panel of the blank (FIGS. 1*a*–6*a*) and is connected therewith via a connecting line 10, which may be perforated. In the variant embodiments shown, the sealing tab 9 is folded over the dispensing opening provision 7 and covers it entirely. The sealing tab 9, on the side thereof proximal to the dispensing opening provision, is at least partly provided with an adhesive layer, allowing the sealing tab 9 to be fixedly attached to a surface of the box around the dispensing opening provision 7.

In the variant embodiment of the box and the associated blank as shown in FIGS. 1 and 1*a*, the dispensing opening provision 7 is provided in a first fold line 11 connecting the front panel 3 and a first top panel 12. The second side panel 6 is connected with the front panel 3 through a second fold line 13 which extends perpendicularly to the first fold line 11 and with the rear panel 4 through a third fold line 14 parallel to the second fold line 13. A second top panel 15 is connected with the rear panel 4 via a fourth fold line 16 extending at right angles to the third fold line 14 and, in the blank (FIG. 1*a*), in line with the first fold line 11.

The second top panel 15, on the side 17 remote from the fourth fold line 16, is provided with a substantially trapezoidal recess 18, of which the side 19, located near the fourth fold line 16, is approximately parallel thereto. Adjacent the side 20 of recess 18 in the second top panel 15, remote from the third fold line 14, the sealing tab 9 is connected through a perforation line 10 with the second top panel 15. The perforation line 10 coincides with a part of the boundary line 19 and the entire boundary line 20 of the recess 18, and the sealing tab 9 extends from the perforation line 10 substantially perpendicularly to the fourth fold line 16 to a point beyond the recess 18. The sealing tab 9 comprises a fifth fold line 21 which coincides with the imaginary boundary of the recess 18 on the free side 17 remote from the fourth fold line 16.

In the erect position of the box, as shown in FIG. 1, the second top panel 15 lies flat on the first top panel 12, the free side 17 of the second top panel 15 substantially coinciding with the first fold line 11. The cut 8 extends from the first top panel 12 through the first fold line 11 into the front panel 3, and the part of the cut 8 that is located in the first top panel 12 lies free within the boundaries of the recess 18. The sealing tab 9 is disposed against the first top panel 12 and the front panel 3, the fifth fold line 21 approximately coinciding with the first fold line 11, and the cut 8 being covered entirely by the sealing tab 9.

When the box (after being filled) is used for the first time, the sealing tab 9 can be gripped at the free end 22 remote from the fifth fold line 21 and be pulled forward and upward, whereby the glued joint of the sealing tab 9 is broken. After the sealing tab 9 has been pulled away at least substantially completely from the dispensing opening provision 7, the sealing tab 9 can be torn off along the perforation line 10. The feature that the part 20 of the perforation line 10 closest to the free side 17 of the second top panel 15 includes an angle with the first fold line 11, prevents the possibility that while the sealing tab 9 is being pulled loose and torn loose, at the same time the second top panel 15 is pulled off of the first top panel 12.

In the second variant embodiment of the box and the associated blank as shown in FIGS. 2 and 2*a*, the dispensing opening provision 7 is provided in a first fold line 211 which connects the front panel 3 and a first top panel 212. The second side panel 6 is connected with the front panel 3 through a second fold line 213, which extends at right angles to the first fold line 211, and with the rear panel 4 through a third fold line 214 parallel to the second fold line 213. A second top panel 215 is connected with the rear panel 4 through a fourth fold line 216, which extends at right angles to the third fold line 214 and, in the blank (FIG. 2*a*), in line with the first fold line 211, and further corresponds substantially with the second top panel 15 as shown in FIG. 1.

A first side panel 5 is connected through a sixth fold line 223 to the rear panel 4 on the side thereof remote from the third fold line 214. A third top panel 224 is connected with the first side panel 5 through a seventh fold line 225 which, in the blank (FIG. 2*a*), extends in line with the first fold line 21 and the fourth fold line 216. The sealing tab 9 is connected with the third top panel 224 through perforation line 10.

The perforation line 10 extends from the intersection 226 of the seventh fold line 225 and the longitudinal edge 227 on the side of the first side panel 5 remote from the sixth fold line 223, and slants across the third top panel 224, approximately along the diagonal line, while the end of the perforation line remote from the above-mentioned corner point 226 is slightly bent in the direction of the side of the third top panel 224 remote from the seventh fold line 225. The sealing tab 9 extends from the perforation line 10 approximately parallel to the seventh fold line 225 and beyond the prolongation of the longitudinal edge 227 on the side of the first side panel 5 remote from the sixth fold line 223, and the fifth fold line 221 approximately coincides with the prolongation of that longitudinal edge 227.

In the box in erect condition, as shown in FIG. 2, the second top panel 215 lies under the first top panel 212. The dispensing opening provision 7 corresponds with the dispensing opening provision 7 as shown in FIG. 1. The third top panel 224 lies flat on the first top panel 212, the sealing tab 9 being disposed against the first top panel 212 and the front panel 3. The fifth fold line 221 approximately coincides with the first fold line 211 and the cut 8 is covered entirely by the sealing tab 9.

This embodiment has the advantage that the sealing tab 9 covers a relatively large part of the edge in which the dispensing opening provision 7 is provided, so that any manipulation of the box will be visible even more clearly. Moreover, by virtue of the slanting perforation line 10, which is slightly bent at one end, an advantageous tearing direction is obtained.

In the variant embodiment of the box and the blank shown in FIGS. 3 and 3*a*, the dispensing opening provision 7 is provided in a first fold line 311 which connects the front panel 3 and a first top panel 312. The sealing tab 9, which is substantially straight in this example, is connected through a perforation line 10 with the first top panel 312 on the longitudinal edge 328 thereof remote from the first fold line 311, and extends substantially at right angles to the first fold line 311 in the direction away therefrom, along the longitudinal edge 329 of the first top panel 312 located near the cut 8.

In the erect position of the box, as shown in FIG. 3, the first top panel 312 lies above the second top panel 315. The dispensing opening provision 7 corresponds with the dispensing opening provision 7 as shown in FIG. 1. The sealing tab 9 has been folded back along the perforation line 10 over the first top panel 312 and lies flat on the top thereof. The sealing tab 9 is provided with a fifth fold line 321, coinciding with the first fold line 311, and the part 322 of the sealing tab 9 that is located on the side of the fifth fold line 321 remote from the first top panel 312, is disposed against the front panel 3.

This variant embodiment of the box according to the invention has the advantage that the perforation line 10, along which the sealing tab is to be torn off, is located on the rear side of the box, the tearing direction being such as to prevent the possibility that one of the panels of the box is damaged or pulled loose as the sealing tab is being pulled loose and torn loose.

In the variant embodiment of the box and blank as shown in FIGS. 4 and 4*a*, the dispensing opening provision 7 is provided in a first fold line 411 which connects the front panel 3 and the first top panel 412. A fourth top panel 430 is connected with the second side panel 6 through an eighth fold line 431, which extends in the prolongation of the first fold line 411. The fourth top panel 430, along the longitudinal edge thereof extending in the prolongation of the second fold line 413, is provided with a second recess 432 substantially corresponding with the recess 18 in the second top panel 415.

Similarly to FIGS. 1 and 1*a*, a sealing tab 9 is connected to the fourth top panel 430 on the side of the second recess 432 remote from the eighth fold line 431. The sealing tab 9 extends from the perforation line 10 substantially parallel to the eighth fold line 431 in the direction of the first top panel 412 and has a slightly bent longitudinal edge on the side 422 of the fifth fold line 421 remote from the fourth top panel 430, on the side proximal to the eighth fold line 431.

In the box in erect position, as shown in FIG. 4, the fourth top panel 430 lies flat on the first top panel 412, and the second top panel 415 lies under the first top panel 412. The dispensing opening provision 7 corresponds with the dispensing opening provision 7 as shown in FIG. 1. The sealing tab 9 has been folded along the fifth fold line 421 and is disposed against the front panel 3.

In the variant embodiment of the box and blank shown in FIGS. 5 and 5*a*, the dispensing opening provision 7 is provided in a first fold line 511, which connects the front panel 3 and a first top panel 512. The sealing tab 9 is connected with the first side panel 5 through a perforation line 10. The perforation line 10 extends from the intersection 526 of the longitudinal edge 527, located on the side of the first side panel 5 remote from the sixth fold line 523, and the seventh fold line 525, along a relatively small part of that longitudinal edge 527. The fifth fold line 521 extends in the prolongation of the seventh fold line 525 across the sealing tab 9.

In the erect position of the box, as shown in FIG. 5, the first top panel 512 lies above the second top panel 515. The dispensing opening provision 7 corresponds with the dispensing opening provision 7 as shown in FIG. 1. The sealing tab 9 has been folded along the fifth fold line 521 and along the perforation line 10, the free end 522 of the sealing tab 9 having been folded onto the first top panel 512, while the remainder of the sealing tab 9 is disposed against the front panel 3.

This variant embodiment of the box according to the invention has the advantage that relatively little additional material is required for the sealing tab and that the tearing direction lies along one of the upright edges, thereby preventing one of the panels being pulled loose or otherwise damaged as the sealing tab 9 is being pulled loose and torn loose.

In the variant embodiment of the box and blank shown in FIGS. 6 and 6*a*, the dispensing opening provision 7 is provided in a ninth fold line 632, which connects the front panel 3 and a third side panel 633. The sealing tab 9 is connected with the first side panel 5 through a perforation line 10. The ninth fold line 632 extends parallel to the second fold line 613 and is located on the side of the front panel 3 remote from the second fold line 613. The first side panel 5, on the longitudinal edge 627 thereof remote from the sixth fold line 623, is provided with a third recess 634, which corresponds substantially with the recess 18 in the second top panel 15 in the blank according to FIG. 1*a*.

In similar manner to that shown in FIGS. 1 and 1*a*, a sealing tab 9 is connected with the first side panel 5 on the side of the third recess 634 located near the seventh fold line 625. The sealing tab 9 extends from the perforation line 10, substantially parallel to the seventh fold line 625 in the direction away from the sixth fold line 623. The sealing tab 9 is provided with a fifth fold line 621 which coincides substantially with the partly imaginary longitudinal edge 627 of the first side panel 5. The sealing tab 9 is moreover provided with a tenth fold line 635, which extends parallel to the fifth fold line 621 on the side thereof remote from the sixth fold line 623. The free end 636 of the sealing tab, located on the side of the tenth fold line 635 remote from the fifth fold line 521, is preferably free of glue and constitutes a pull tab.

In the box in erect position, as shown in FIG. 6, the first side panel 5 is disposed against the outside of the third side panel 633. The dispensing opening provision 7 corresponds with the dispensing opening provision 7 as shown in FIG. 1. The sealing tab 9 is then disposed against the third side panel 633 and the front panel 3, the fifth fold line 621 coinciding approximately with the ninth fold line 632. The pull tab 636 may then be disposed against the front panel 3 but is not connected therewith.

This variant embodiment has the advantage that the sealing tab can be readily gripped in order to break the seal. Moreover, the blank (FIG. 6*a*) from which the box (FIG. 6) can be folded has the advantage that it has substantially straight, parallel longitudinal edges, so that the blank can be manufactured from a straight strip with relatively little loss of material.

It holds for FIGS. 7–9 that the dispensing opening is formed by removing a box portion 740, 840, 940, which is bounded by the perforation or tear line 708, 808, 908 which in itself is closed. The box portion 740, 840, 940 which can be removed to form the dispensing opening extends in two panels 3 and 12 and, by virtue of its being located on an edge 11, can be readily gripped by hand and removed accordingly. The exemplary embodiment shown in FIG. 9 further comprises a nail hole 946 for the purpose of improving the possibilities of gripping the box portion 940 to be removed. The nail hole 946 is covered on the inside of the box by a cover panel 942 integrally connected with a glue panel. Since the dispensing opening provision 7 is not reclosable in this case, the sealing tab 9 can be brought into a closing position wherein the dispensing opening formed upon removal of the box portion 740, 840, 940 is substantially closed. In order to keep the sealing tab 9 in the closing position, the box may be provided with a slit 841 (see FIGS. 8 and 8*a*) in which the sealing tab 9 is received in the closing position. The slit 841 may be formed between two panels or panel portions 3 and 842, 942, partly adhered onto each other. In the exemplary embodiment of FIG. 9, the panel 942 covering the nail hole 946 also serves for forming the slit 941. The slit 841 can also be designed as an incision in a wall panel, with the result that in the closing position at least a part of the sealing tab 9 is disposed in the interior of the box. In an alternative embodiment, the sealing tab 9 may be provided with a re-adhesive adhesive, by means of which an adhesion portion 722 (see FIG. 7) of the sealing tab 9 can be affixed to the front wall 3. Optionally, the sealing tab may be provided with an additional fold line 735 to form a pull tab 736. In the exemplary embodiment shown in FIG. 7, the sealing tab 9 has the same width as, and a greater length than, a top panel of the box. In the exemplary embodiment shown in FIGS. 8 and 8*a*, the sealing tab 9 is connected with a top panel 15 of the box, partly through a perforation line 10 and partly through a fold line 843. The perforation line 10 is provided in such a manner that it must be broken to dislodge the sealing tab 9 from the sealing position. The sealing tab 9 continues to be connected with top panel 15 through the fold line 843. A broken perforation or tear line indicates a broken seal, so that it will be clear to the consumer whether the packaging has been opened before. In the exemplary embodiment shown in FIG. 9, the sealing tab 9 is entirely embedded in the second top panel 15 which continues over the panel 3. The sealing tab 9 has been rendered easy to grip by virtue of a second nail hole 945 provided in the part of the second top panel 15 folded against the sidewall 3. The exemplary embodiment of FIG. 9 moreover comprises a dispensing distribution panel 944 which is integrally connected with the cover panel 942. The dispensing opening, which is cleared through removal of the box portion 940, is covered by the dispensing distribution panel 944 in that panel 944 has been adhered to the first top panel 12 on the side thereof located on the inside of the box. The dispensing distribution panel is provided with a perforation 947 for the distribution of the dispensing pattern.

It goes without saying that the sealing tab 9 of the exemplary embodiments shown in FIGS. 1–6 may also be connected with the panel on which it has been formed, through a fold line. Because in these exemplary embodiments the dispensing opening provision 7 itself is closable, however, the need for a closure of the opening by means of the sealing tab 9 is less urgent. Accordingly, in these exemplary embodiments the connection between the sealing tab 9 and the panel on which it has been formed is so designed that the sealing tab 9 can be pulled loose after the seal of the box has been broken.

The invention is not in any way limited to the embodiments shown in the drawings. Thus, the box may comprise different dispensing openings in an edge, or at a different point. Further, the sealing tab can be designed in a different form or be formed on a different panel, such as for instance the third side panel. Further, it will be clear that the perforation line and/or the sealing tab can extend in other directions than those shown, and the box can have all kinds of shapes other than the block shape shown, all within the scope of the invention.

I claim:

1. A box folded from a blank comprising wall panels and glue panels, which box has a substantially closed form and comprises a dispensing opening provision which extends in two wall panels adjoining each other through an edge of the box for forming a dispensing opening at the location of the edge, wherein at least one of the panels of the blank comprises an integrally formed sealing tab which in an initial sealing position covers the dispensing opening provision in such a manner as to prevent formation of the dispensing opening, wherein the dispensing opening provision is adapted to be removed a single time for the purpose of forming the dispensing opening, and wherein the sealing tab, after the dispensing opening has been formed by removal of the dispensing opening provision, can be brought into a closing position wherein the dispensing opening is at least substantially closed by the sealing tab, wherein the dispensing opening provision comprises a box portion bounded by a first separation line which is closed in itself, which box portion extends in said two wall panels, wherein the sealing tab is connected with the panel on which it has been integrally formed, partly through a fold line and partly through a second separation line, the second separation line being provided in such a manner that it must be broken to dislodge the sealing tab from the sealing position, wherein one of the panels, which contains the box portion bounded by the first separation line, comprises a first nail hole, wherein the first nail hole is covered on the interior of the box by a cover panel which is integrally connected with a glue panel and which is connected, through adhesive, with the side of the panel containing the first nail hole proximal to the interior of the box, wherein the sealing tab is embedded entirely in the panel on which it has been integrally formed, the sealing tab being readily grippable by virtue of a second nail hole in said panel.

2. A box according to claim 1, wherein a slit is provided in which the sealing tab is received in the closing position, wherein the slit is formed between the cover panel which is integrally connected with the glue panel and the panel containing the first nail hole.

3. A box according to claim 1, wherein a slit is provided in which the sealing tab is received in the closing position, wherein the slit is formed by an incision in a wall panel, so that in the closing position at least a part of the sealing tab is located in the interior of the box.

4. A box according to claim 1, wherein the sealing tab or the wall panel disposed against the sealing tab in the closing position thereof is provided with a reusable adhesive, so that the sealing tab in the closing position thereof closes the dispensing opening again on each subsequent occasion.

5. A box according to claim 1, wherein it comprises a dispensing distribution panel which covers the dispensing opening which is formed through removal of the box portion bounded by the first separation line, the dispensing distribution panel comprising a perforation at the location of the dispensing opening.

6. A box according to claim 5, wherein the dispensing distribution panel is adhered to the panel containing the dispensing opening on the side proximal to the interior of the box.

7. A box according to claim 1, wherein the sealing tab in the sealing position closes the dispensing opening in an entirely liquid-tight manner.

8. A box according to claim 1, wherein the sealing tab comprises adhesive.

9. A box according to claim 8, wherein the adhesive is provided in such a manner that in the sealing position of the sealing tab, the dispensing opening provision and mouth edges thereof are free of adhesive.

* * * * *